United States Patent [19]

Steinhardt

[11] 4,324,498

[45] Apr. 13, 1982

[54] MULTIPLE INDEX PRINTWHEEL

[75] Inventor: Maxwell Steinhardt, Orinda, Calif.

[73] Assignee: Qume Corporation, San Jose, Calif.

[21] Appl. No.: 124,766

[22] Filed: Feb. 26, 1980

[51] Int. Cl.[3] ..... B41J 00/00

[52] U.S. Cl. ..... 400/144.2; 400/175

[58] Field of Search ..... 400/144.2, 144.3, 174, 400/175, 53; 101/93.38, 93.39, 93.40

[56] References Cited

U.S. PATENT DOCUMENTS 2,629,478 2/1953 Simon ..... 400/464
3,432,018 3/1969 Watanabe et al. ..... 400/464
4,121,517 10/1978 Dobson ..... 101/111 X
4,165,189 8/1979 Bauer ..... 400/144.2

*Primary Examiner*—Paul T. Sewell
*Attorney, Agent, or Firm*—Irving Keschner

[57] ABSTRACT

A printwheel for an impact printer is disclosed. The printwheel has a central hub in which are located several index holes. The printwheel is also provided with multiple sets of character of symbol type fonts, each set having an index hole associated therewith and each index hole being located in the same relative position with respect to its associated set.

2 Claims, 3 Drawing Figures

MULTIPLE INDEX PRINTWHEEL

BACKGROUND

This invention relates to printwheels used in a printing apparatus and more particularly to printwheels having multiple sets of character or symbol type fonts.

In the prior art, daisywheel printers are quite well known, and, in fact, have enjoyed a large commercial acceptance as a high quality impact printer. While daisywheel printers have most often been used in applications requiring a large character set (typical daisywheel printwheels have ninety-six different character and symbol fonts or type face disposed at the ends of the spokes of the wheel), some specialized applications have made use of significantly fewer different fonts. These applications include numeral printers (printers which apply the magnetic ink numerals and symbols at the bottom of bank checks are exemplary numeral printers), printers used for graphics and plotting and printers used for facsimilie reproduction. In each of these applications, the character set is significantly shorter than the normal 96 character alphanumeric printwheel. Also, it should be evident that as the character set decreases in size, the useage rate of the individual characters or symbols increases. Because these printers are impact printers, the character fonts, with time, will either wear out or distruct.

To prolong the effective life of printwheels used in such applications, prior art printwheels have been equipped with multiple sets of these shorter character sets on a single wheel. Note FIG. 1, where such a printwheel is identified by numeral 1 and where each of the multiple sets is identified by the letter A. The printwheel 1 has a central hub 11 in which is disposed a single index hole 12. The printer is typically controlled by a programmable device, which, in this instance, is especially programmed to select different character sets as each set wears out or destructs. The disadvantage of such specialized programming is, of course, the necessity and cost of having it written.

It was, therefore, one object of this invention to improve such printers to alleviate the need to provide such specialized programming but still provide a printwheel with multiple sets of character fonts.

BRIEF DESCRIPTION OF THE INVENTION

The foregoing object is achieved as is now described. A printwheel is provided with multiple sets of character fonts or type faces, the number of sets depending upon the number which may be conveniently disposed at the printing surface or periphery of the wheel. An index hole or notch is provided for each set in the hub of the printwheel. The hub is preferably made from a plastic material and each hole or notch is preferably provided with a thin plastic layer or flashing. The flashing is located such that it is easily punctured when the printwheel is installed in the printer and the index pin (alignment stud), which is attached to the rotor of the printwheel motor, enters the hole or notch. After a set of characters wears out or destructs, the printer's operator manually moves the printwheel and places a new set of characters in position for printing by causing the index pin on the printer to puncture the flashing of a different index hole or notch. The operator will be able to immediately identify which sets of characters are worn out since their index holes or notches will have punctured flashings. When all flashings have been punctured, it is, of course, time to replace the wheel.

BRIEF DESCRIPTION OF THE DRAWINGS

The novel features believed to be characteristic of the invention are set forth in the appended claims. The invention itself however, as well as a preferred mode of use, further objects and advantages thereof, will be best understood by reference to the following detailed discussion of an illustrative embodiment when read in conjunction with the accompanying drawings, wherein:

BRIEF DESCRIPTION OF A PREFERRED EMBODIMENT

Figure 1:
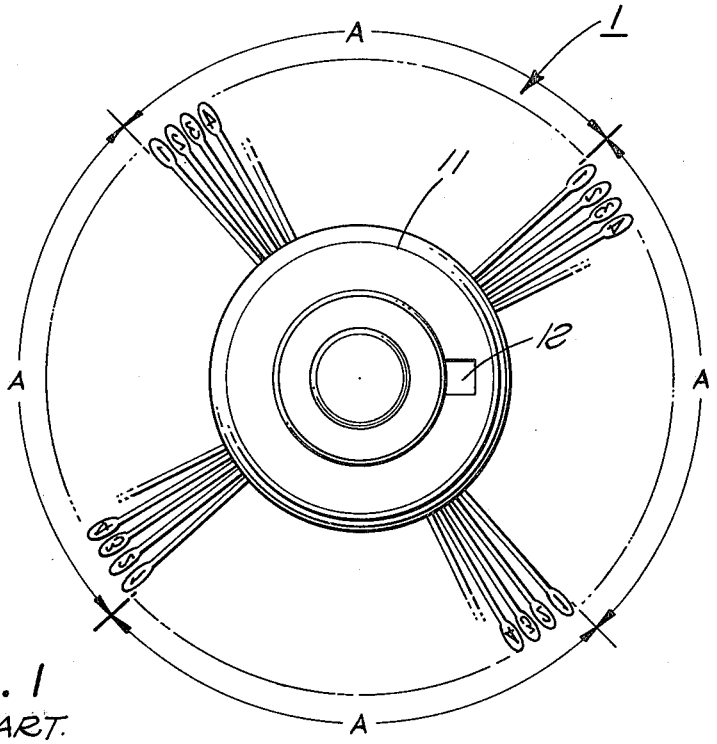
FIG. 1 PRIOR ART.
FIG. 1 is a plan view of a prior art printwheel with multiple character sets.
Figure 2:
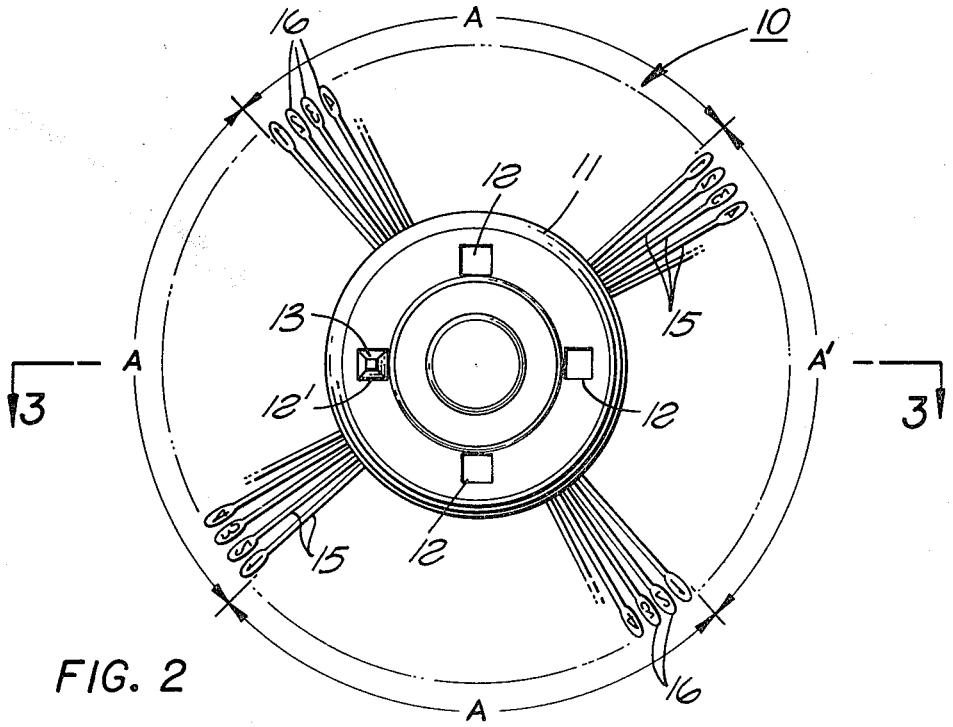
FIG. 2 is a plan view of my printwheel having multiple character sets and associated index holes, the printwheel shown mounted on the rotor of the printer's printwheel motor.

Referring now to FIG. 2, there is depicted a plan view of my printwheel 10. It has a central hub 11 in which several index holes 12 are located. In one of the holes 12' is depicted an index pin 13, which is fixatively attached to the rotor 14 (FIG. 3) of the printwheel motor on which printwheel 10 is mounted. Radially extending from hub 11 are a plurality of spokes 15, at the ends of which are located the character type or fonts 16. The printwheel motor is controlled by a servomechanism which accurately controls the angular position of rotor 14. Index hole 12' and pin 13 assure proper angular registration between rotor 14 and fonts 16 thereby permitting the servomechanism to accurately place a selected font in a printing position adjacent to a print hammer 19 (FIG. 3).

On this printwheel the set of character fonts or type repeat four times, each set being identified by the letter A. There are four index holes 12, each index hole 12 being associated with a set A. Furthermore, each index hole 12 is located in the same relative angular location relative to its associated set A. Thus, index hole 12' could well be associated with set A' , and so forth, although the particular angular relationship selected is a matter of design choice. As previously mentioned, the number of multiple sets (and thus the number of associated index holes) is a matter of design choice.

When manufactured, each index hole 12 is preferably provided with a thin layer or flashing 17 (FIG. 3) of material, which is easily punctured by index pin 13 when wheel 10 is placed on rotor 14 and index pin 13 is received into an index hole 12 having flashing 17 associated therewith.

Figure 3:
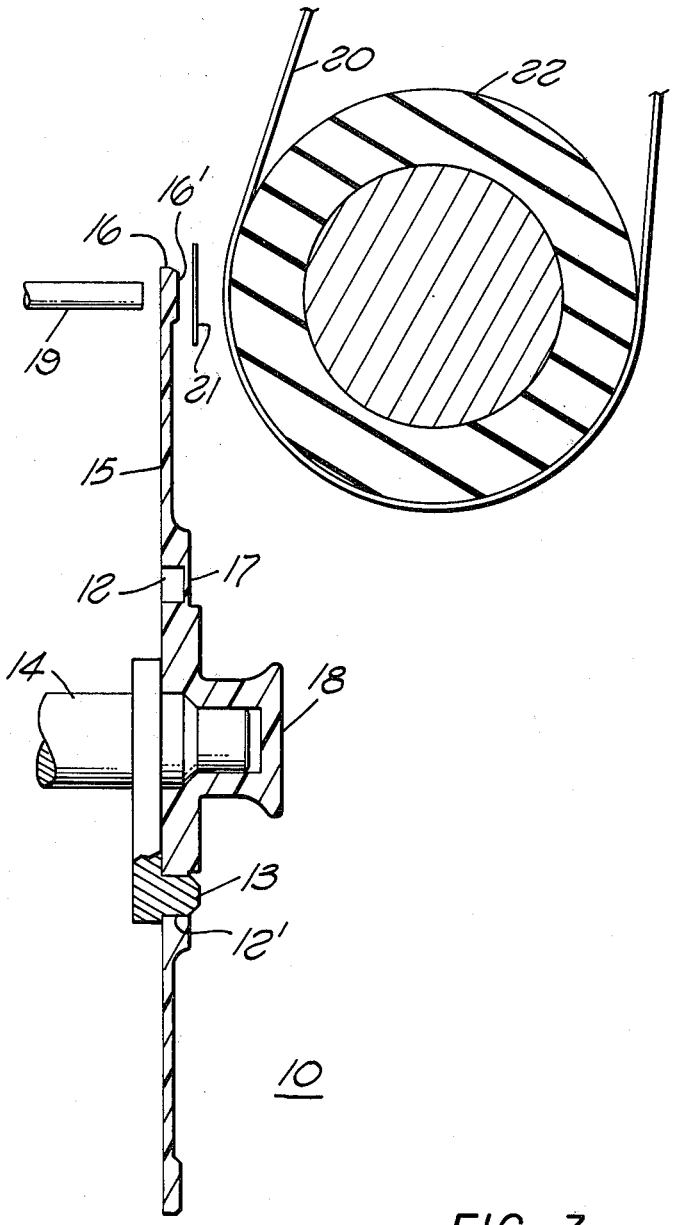
FIG. 3 is a section view through the printwheel and and the index pin of FIG. 2.

Turning now to FIG. 3, there is depicted a sectional view through printwheel 10, as shown in FIG. 2. Also shown in FIG. 3 are rotor 14 and hammer 19 as well as a record medium 20, a ribbon 21 and a platen 22. Mounted on rotor 14 is the index pin or alignment stud 13. Rotor 14 rotates printwheel 10 about its axis (when the printwheel motor is energized by the aforementioned servomechanism) to bring different type into the printing position adjacent to print hammer 19. When the print hammer 19 fires, it impacts the type 16 in the printing position and moves toward the record medium 20 (usually paper) and inked ribbon 21 disposed between the impacted type 16 and the record medium 20. The record medium is preferably supported by platen 22 or a type bar. The type face 16' embossed on the type 16 cause printing to occur.

Rotor 14 preferably enters a cup 18 on printwheel 10 and pin 13 enters an index hole 12 when the printwheel 10 is installed on rotor 14. In FIG. 3 pin 13 is depicted in lower index hole 12' while no pin has as yet entered the upper index hole 12, which is evident by the existance of the flashing 17 in the upper index hole 12. After the type associated with the lower index hole 12' have worn out, the operator simply removes the printwheel 10 and reinstalls it such that pin 13 enters an index hole 12 having flashing 17 intact. Of course, this installation operation will puncture in flashing 17. When the last set of type wears out, all the flashings 17 will be punctured and the operator is thereby alerted to replace the printwheel. The thickness of flashing 17 is exaggerated in FIG. 3 for the sake of clarity of illustration. The flashing 17 is preferably very thin.

Preferably hub 11 is made of a plastic material, such as, for instance, nylon, and the index holes and associated flashing 17 are molded into the hub at the same time that hub 11 itself is made. While I prefer to use plastic materials for the hub 11 due to their light weight and low cost, other materials may be useful in certain applications and thus it may be advantageous to use the flashing made out of other materials (e.g. paper) in lieu of plastic materials.

Having described the invention in connection with certain specific embodiments thereof, further modification may now suggest itself to those skilled in the art. For example, it should be apparent that this invention may be used with printers other than printers of the daisywheel type, such as drum or ball printers. It is to be understood that this invention is not limited to the specific embodiments disclosed, except as set forth in the appended claims.

What is claimed is:

1. A printwheel for a printer comprising:

a hub;

multiple sets of spokes attached to said hub and extending radially therefrom, a character type or font being formed at the ends of said spokes; and multiple index means in said hub for receiving an index pin associated with said printer, a separate index means being associated with each of said sets of spokes, each of said separate index means being positioned substantially at the same relative location in said hub with respect to its associated set of spokes, each said index means being provided with a layer of material positioned such that said index pin will puncture the layer provided on one of said index means when said printwheel is installed on said printer.

2. The printwheel as defined in claim 1 wherein the punctured layers on said index means form openings, the openings providing a visual indication that characters on the sets of spokes associated with said openings are inoperative.

* * * * *